US007255708B2

(12) United States Patent
Kim et al.

(10) Patent No.: US 7,255,708 B2
(45) Date of Patent: Aug. 14, 2007

(54) MEDICAL CHAIR

(75) Inventors: Sang Cheol Kim, 1-35-15, Higashikanamachi, Katsushika-ku, Tokyo-to (JP); Masayuki Nakamura, 105-1, Simobetto-cho, Kitashirakawa, Sakyo-ku, Kyoto-shi, Kyoto-fu (JP)

(73) Assignees: Masayuki Nakamura, Kyoto-fu (JP); Sang Cheol Kim, Tokyo-to (JP); Masayuki Kamekawa, Nara-ken (JP); Katsuhiko Taki, Tokyo-to (JP)

( * ) Notice: Subject to any disclaimer, the term of this patent is extended or adjusted under 35 U.S.C. 154(b) by 359 days.

(21) Appl. No.: 10/924,949

(22) Filed: Aug. 25, 2004

(65) Prior Publication Data

US 2005/0216061 A1 Sep. 29, 2005

(30) Foreign Application Priority Data

Mar. 25, 2004 (JP) ..... 2004-088576

(51) Int. Cl.
*A61H 1/00* (2006.01)

(52) U.S. Cl. ..... 606/237; 606/241; 128/845

(58) Field of Classification Search ..... 601/23, 601/24, 26, 133; 602/32; 606/237, 241; 482/134, 142, 145; 128/845, 846; 297/411.2, 297/411.31, 411.36, 284.3, 284.4, 284.8, 297/464

See application file for complete search history.

(56) References Cited

U.S. PATENT DOCUMENTS 1,356,365 A * 10/1920 Hosmer ..... 602/32
3,675,646 A * 7/1972 Corcoran ..... 602/32
3,815,586 A * 6/1974 Kazik ..... 606/237
3,878,840 A * 4/1975 Esbelin ..... 606/237
5,098,088 A * 3/1992 Cohen et al. ..... 601/24
5,642,302 A * 6/1997 Dumont et al. ..... 128/845
6,251,123 B1 * 6/2001 Patner ..... 606/237

FOREIGN PATENT DOCUMENTS

JP 09-051924 A1 2/1997
JP 2003-038524 A1 2/2003

* cited by examiner

*Primary Examiner*—Quang D. Thanh
(74) *Attorney, Agent, or Firm*—Rader, Fishman & Grauer PLLC

(57) ABSTRACT

A medical chair has a cranium position regulating device and a pelvis-and-knee position regulating device for respectively regulating the positions of the cranium and pelvis of a subject who sits on a seat. The cranium position regulating device and the pelvis-and-knee position regulating device have structures in which they butt against both right and left sides of the cranium and the pelvis, respectively, to cause both planes centered in a right-and-left direction of the cranium and the pelvis to be in a same central plane which extends in the direction of gravity. An ideal condition of the body of the subject in which vertical and horizontal balances are achieved against the force of gravity can be achieved to ensure physiological curvature of vertebrae and the condition can be maintained.

10 Claims, 7 Drawing Sheets

MEDICAL CHAIR

FIELD OF THE INVENTION

The present invention relates to a medical chair which realizes physiological curvature of individual vertebrae, whereby muscular tension of a human body is relaxed as much as possible, and particularly to a medical chair suitable for a medical treatment that, for example, synthetically pursues the balance of a human body.

BACKGROUND OF THE INVENTION

A human body ideally exists by nature in a condition where the human body is balanced vertically and horizontally against the force of gravity. The condition where the human body is balanced against the force of gravity is fundamentally realized by interrelation among 206 to 208 bones. At present, there has been proposed no medical treatment apparatus nor medical treatment method for synthetically pursuing the balance of a human body based on understanding the roles and conditions of the bones.

Conventionally, when various measurements are to be performed by using various dental diagnostic apparatuses, for example, the measurements are usually performed by using a medical chair having a tiltable back plate (for example, see Japanese Patent Publication (Kokai) No. HEI9-51924) in a condition where the subject lies on the back plate of the treatment table which is made horizontal.

In order to measure the shapes of the dental arches and occlusion of the maxilla and mandible of the human body, for example, the subject in such a condition bites an articulating sheet which is produced by applying a coloring agent such as carbon to both faces of a base material such as paper, and the states of the dental arches and occlusion of the subject are checked on the basis of the change in color of portions of the articulating sheet which are in contact with the teeth. In this case, however, the obtained states of the dental arches and occlusion are only those in the condition where the subject lies or is inclined backwards. Therefore, it is impossible to correctly know the states of the dental arches and occlusion.

In order to solve the problem, a method of detecting dental occlusion, and an articulating sheet have been proposed in which temporally fixing means such as a metal core wire is integrated with the articulating sheet, and the measurement for dental occlusion is performed in a condition where the articulating sheet is temporally fixed to teeth or a dental arch of a subject, so that the dental occlusion of the subject in a natural condition can be measured (for example, see Japanese Patent Publication (Kokai) 2003-38524).

However, it was found by the study of the inventors of the invention that the dental occlusion of a subject cannot be correctly known even when the dental occlusion examining method using the articulating sheet disclosed in the above-identified patent publication is used. This is caused because, when the subject in a natural condition where the subject naturally sits on a chair or stands bites the articulating sheet, for example, the subject unconsciously senses a point which becomes into contact with the sheet at the earliest timing (premature contact), and the brain causes the positions of the cranium and the cervical vertebrae to be displaced so as to achieve a balance of the occlusal plane in the front-and-aft and right-and-left directions. Even when the articulating sheet is bitten in such a displaced condition of the cranium and the cervical vertebrae and the bitten result is examined, the occlusal condition cannot be correctly known.

It has been ascertained in studies for long years by the inventors of the invention that such dental arches and occlusal condition can be correctly known when the motions of various regions of the subject are regulated in a condition where the horizontal and vertical balances between the cranium and the cervical vertebrae are achieved.

SUMMARY OF THE INVENTION

It is an object of the invention to realize a medical chair which is useful, for example, in the case where the dental arch and the occlusal condition are to be measured correctly, and also in various medical treatment methods that synthetically pursue the balance of a human body, and which can relax muscular tension of the human body as much as possible in a condition where the human body extends along the direction of gravity while ensuring physiological curvature of the individual vertebrae.

In order to attain the object, the medical chair of the invention is mainly useful for maintaining a relaxed condition of muscular tension of a human body in a condition where physiological curvature of individual vertebrae is realized and the human body extends along a direction of gravity, and characterized in that the chair comprises cranium position regulating means and pelvis position regulating means for respectively regulating a position of a cranium and a position of a pelvis of a subject who sits on a seat, and the cranium position regulating means and the pelvis position regulating means butt against both right and left sides of the cranium and the pelvis, respectively to cause both planes centered in a right-and-left direction of the cranium and the pelvis to be in a same central plane which extends in the direction of gravity (Claim 1).

In the invention, a configuration in which the chair further comprises height adjusting means for adjusting a height of a seat face of the seat from a floor, or a vertical distance between a foot sole placing plate which is additionally disposed and the seat face, to cause soles of feet of the subject in a seated condition to be closely in contact with a horizontal plane may be preferably employed (Claim 2).

In the invention, it is preferred that the chair further comprises knee position regulating means for butting against knees of the subject in a seated condition to cause an angle formed by the knees to be bilaterally symmetrical about the central plane, thereby fixing positions of the knees (Claim 3), that the chair further comprises lumbar vertebra pressing means for, from a rear side, pressing lumbar vertebra of the subject in a seated condition at a predetermined height from the seat (Claim 4), and that the chair further comprises armpit position regulating means for butting against both armpits of the subject in a seated condition to cause a plane centered in the right-and-left direction of the armpits to be in the central plane, thereby fixing positions of the armpits (Claim 5).

In the invention, a configuration is preferably employed in which the chair further comprises cranium fore-and-aft position regulating means for butting against a back of a head of the subject in a seated condition, thereby regulating a position of the cranium in a fore-and-aft direction (Claim 6).

In the invention, a configuration may be employed in which the chair further comprises seat face angle adjusting means for changing an angle of a seat face of the seat with respect to a horizontal plane (Claim 7), or in which a hole or a recessed portion is formed in a substantially central portion of a seat face of the seat (Claim 8).

In the invention, specifically, each of the cranium position regulating means, the pelvis position regulating means, and/or the armpit position regulating means may include: a pair of regulating members which are respectively positioned on right and left sides of the subject in a seated condition, and which butt against a corresponding region; and an adjusting mechanism which moves the pair of regulating members in a horizontal direction, and each of the adjusting mechanisms moves the pair of regulating members by equal distances in a bilaterally symmetric manner about a center line of the chair (Claim 9).

In the invention, it is preferred that, in the cranium position regulating means, the armpit position regulating means, and the lumbar vertebra pressing means, members butting against the subject are disposed in a vertically movable manner by means of respective vertical movement mechanisms in accordance with a body shape of the subject (Claim 10).

Moreover, in the invention, the chair may further comprise storing means for storing positions of the pairs of regulating members in the cranium position regulating means, the pelvis position regulating means, and the armpit position regulating means, a position of a pressing member in the lumbar vertebra pressing means, and/or an angle of a seat face in the seat face angle adjusting means for each subject, and, when an instruction is given, and the positions of the pairs of regulating members and the pressing member, and/or the angle of the seat face may be automatically reproduced to positions or an angle corresponding to the subject, by means of actuators, based on contents of the storing means (Claim 10).

The invention has been conducted as a result of intensive studies of apparatuses which can easily realize and maintain an ideally balanced condition, by focusing attention on the fact that, when an ideal condition of the body of the subject in which vertical and horizontal balances are achieved against the force of gravity can be maintained, the dental occulsional condition and the physiologic condition of the subject can be correctly known.

Specifically, the condition where the vertical and horizontal balances are achieved against the force of gravity can be explained in view of the relationship between the first cervical vertebra (atlas) and the skull. The skull must be positioned on a center line of the first cervical vertebra and the skull. For this purpose, the fore-and-aft and right-and-left balances of the face are important. In addition, it is necessary to check the principle balance of the head, the first cervical vertebra, and the soles of the feet in the walking motion against the force of gravity. For the walking motion, the cervical vertebra, the dorsal vertebra, the lumbar vertebra, the pelvis, the bones of the legs, and the like are correlated with one another. The fore-and-aft balance is determined by the relationships among the pelvis, the positions of the knees, and the soles of the feet. It is the most ideal position that each the right and left legs is opened by 45 degrees with respect to the center of a seat, from a condition where the person sits on a chair and the knees are put together (20 to 80 degrees are also effective). In addition, when the lumbar vertebra is fixed in this condition, the physiologic S-shaped curvature (ideal form) from the lower body to the pelvis, the lumbar vertebra, the dorsal vertebra, and the cervical vertebra is restored. When there exists deviation in physiological curvature, or deviation of the head in the fore-and-aft or right-and-left direction, distortion due to the deviation is concentrated in the head and the first cervical vertebra. This condition can be known by using the medical chair according to the invention.

Most fundamentally, as in the invention of Claim 1, the cranium position regulating means and pelvis position regulating means for, in the right-and-left direction, regulating the positions of the cranium and pelvis of the subject who sits on the seat are provided. The cranium and pelvis of the subject are fixed in such a manner that respective planes (median planes) centered in the right-and-left direction of the cranium and the pelvis are both in the same plane (central plane) along the direction of gravity. Therefore, the above-described condition where the vertical and horizontal balances are achieved can be realized.

At this time, the soles of the feet may be closely in contact with the floor. Alternatively, a foot sole placing plate may be additionally disposed, and the soles of the feet may be closely in contact with the surface thereof. As in the invention of Claim 2, the height adjusting means for adjusting the height of a seat face with respect to the floor, or the vertical distance between the surface of the foot sole placing plate and the seat face may be provided. Therefore, the adjustment in accordance with the size of the body of the subject can be easily performed.

As in the invention of Claim 3, the knee position regulating means for butting against the knees of the subject who sits on the seat so that the angles formed by the knees are bilaterally symmetrical about the central plane, thereby fixing the knees is provided, and, as in the invention of Claim 5, the armpit position regulating means is provided. When the plane centered in the right-and-left direction between the armpits of the subject is in the above-mentioned central plane, therefore, it is possible to more surely bring the posture of the subject much closer to an ideal condition in which vertical and horizontal balances are achieved.

Moreover, as in the invention of Claim 4, the lumbar vertebra pressing means for, from the rear side, pressing the lumbar vertebra of the subject at a position which is separated by a predetermined distance from the seat in a condition where the subject sits on the seat may be disposed. According to the configuration, in corporation with the cranium fore-and-aft position regulating means provided in the invention of Claim 6, the formation of the physiologic S-shaped curvature from the lower body to the pelvis, the lumbar vertebra, the dorsal vertebra, and the cervical vertebra is promoted. The cranium fore-and-aft position regulating means contributes also to further assurance of the positioning of the cranium of the subject.

Depending on the condition of the subject, there may be a case where, even when the seat face is horizontal, the physiological curvature of the vertebrae is not realized, that is, the lumbar vertebra is not put forward. It has been found by the previous studies that, in such a case, as in the invention of Claim 7, the means for adjusting the angle of the seat face of the seat with respect to the horizontal plane is used as needed, and the angle is adjusted so that the height of the knee is higher than the seat face, i.e., the buttocks, whereby the physiological curvature of the vertebrae can be realized.

As in the invention of Claim 8, when the hole or the recessed portion is formed in the substantially central portion of the seat face of the seat, it is possible to prevent a phenomenon that the caudal vertebra butts against the seat face to impair the posture of the subject, from occurring. Even for a subject who has protruding caudal vertebra, therefore, treatment can be easily performed. When such a configuration is employed, it is preferable to set the width of the seat face, or the size of the hole or the recessed portion to be variable in accordance with the body shape of the subject.

As for the cranium position regulating means, the pelvis position regulating means, and the armpit position regulating means which are used for regulating the positions in the right-and-left direction of the respective regions of the subject, as in the invention of Claim 9, the pair of regulating members butt against the corresponding region of the subject, and the regulating members are moved by equal distances in a bilateral symmetrical manner about the center line of the chair. According to the configuration, it is possible to facilitate the operation of positioning the respective regions in the right-and-left direction.

In the cranium position regulating means, the armpit position regulating means, and the lumbar vertebra regulating means, as in the invention of Claim 10, the members butting against the subject are configured so that they can be vertically moved in accordance with the body shape of the subject. Therefore, treatment can be performed for any subject irrespective of the body shape.

As in the invention of Claim 10, the storing means for, for each subject, storing the positions (horizontal and vertical positions) of the members butting against the subject in the cranium position regulating means, the pelvis position regulating means, the armpit position regulating means, and the lumbar vertebra pressing means, and the seat face angle of the seat face angle butting means may be provided, and the respective members and the angle of the seat face may be automatically driven by actuators in response to an instruction and on the basis of the contents of the storing means, thereby reproducing the positions and the angle in accordance with the subject. According to the configuration, for the same subject, it is necessary only to adjust once the positions of the respective members or the seat face angle in the first measurement for the subject, and, in the second and subsequent measurements, it is unnecessary to perform the adjustment operation.

According to the invention, a subject is seated, and the respective regulating means are then adjusted. Therefore, muscular tension of the human body can be relaxed as much as possible while ensuring physiological curvature of the individual vertebrae of the subject. As a result, any deviation of physiological curvature existing in the subject, or any deviation of the head in the fore-and-aft and right-and-left directions can be surely known. Thus, it is possible to find treatment policy for synthetically pursuing the balance of the human body. In addition, when the dental occlusion is measured in this condition, for example, the treatment policy relating to the occlusion can be found unmistakably.

DESCRIPTION OF THE PREFERRED EMBODIMENTS

Hereinafter, embodiments of the invention will be described with reference to the accompanying drawings.

Figure 1:
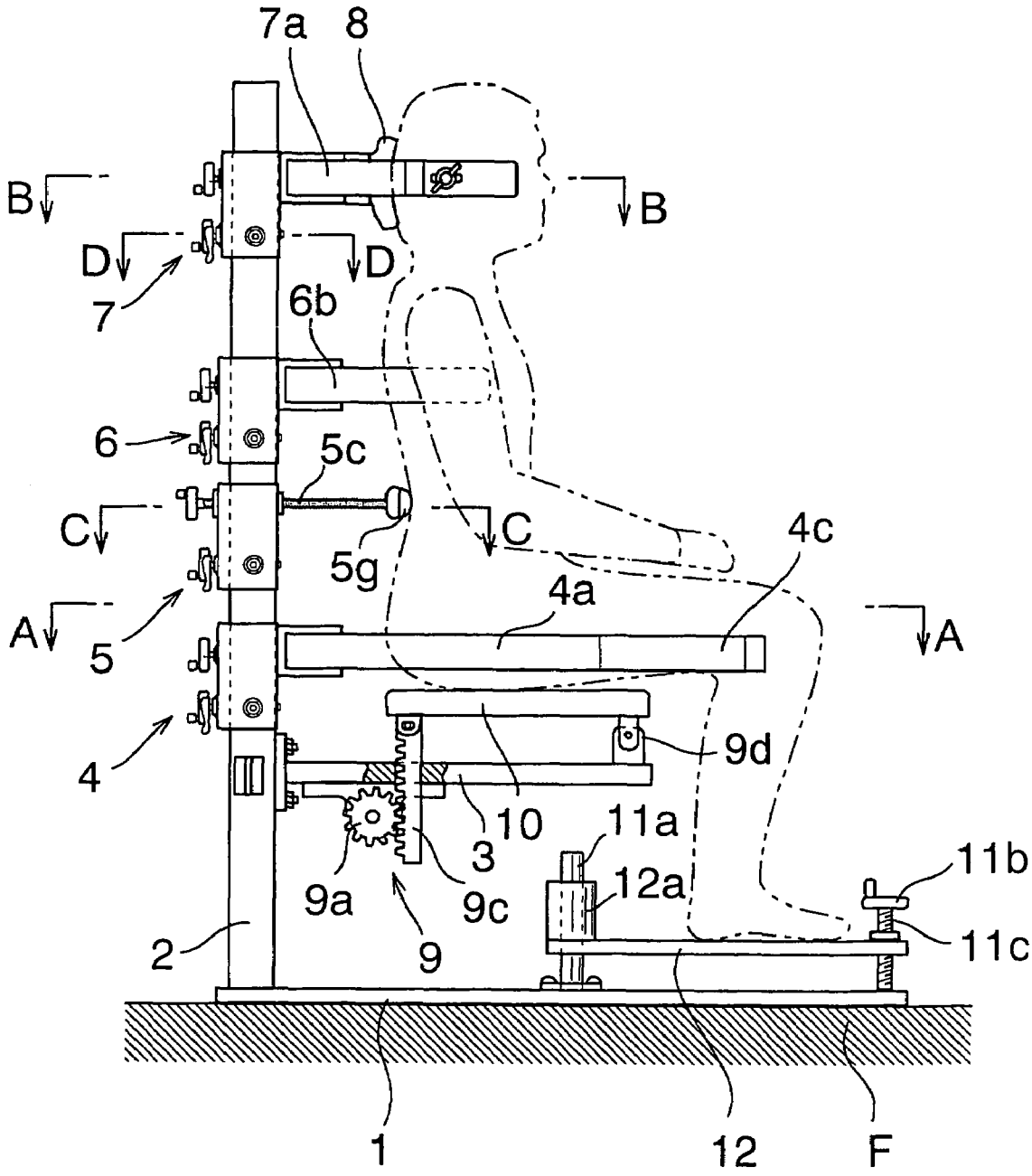
FIG. 1 is a view in which an embodiment of the invention is seen from one side.
Figure 2:
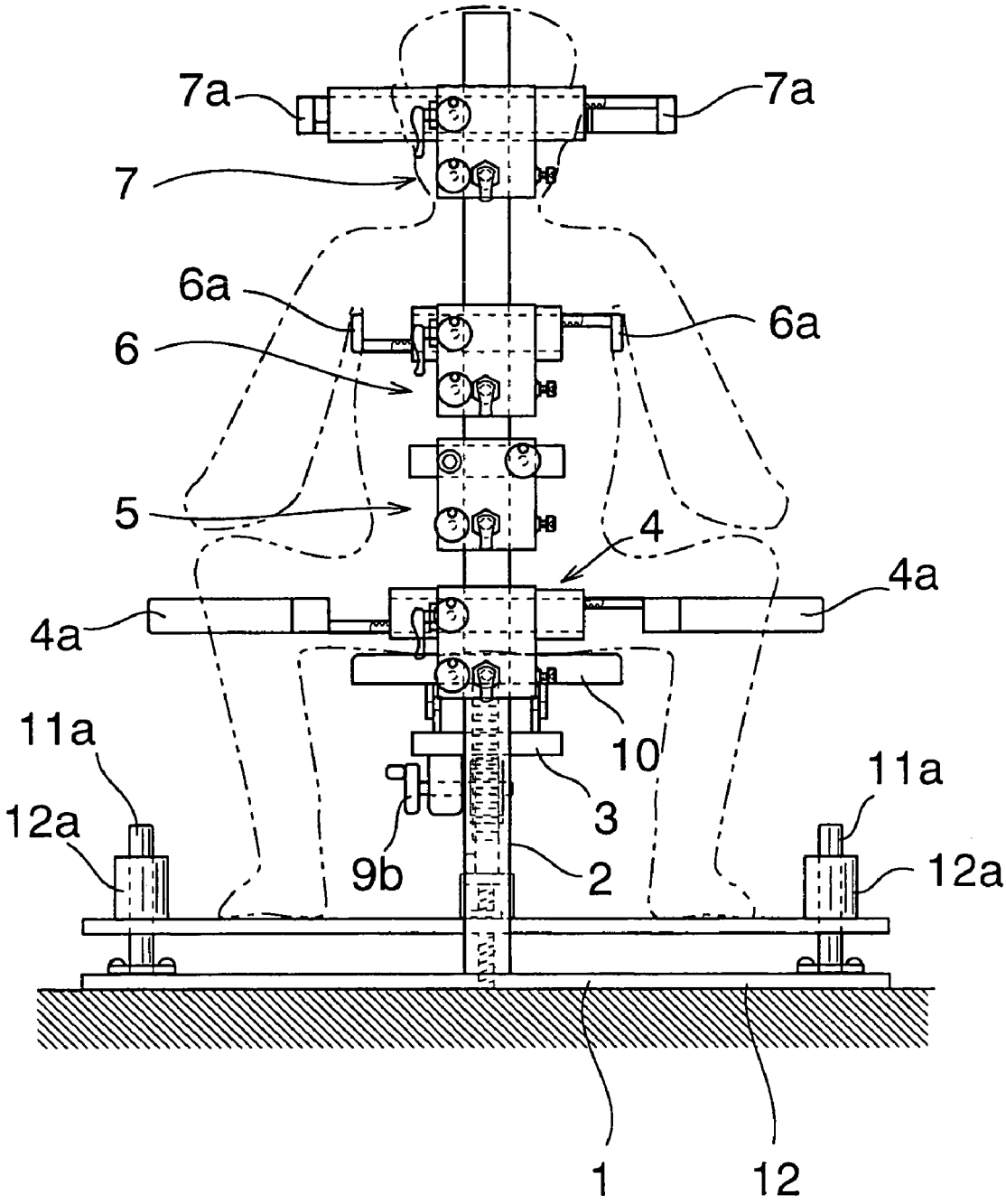
FIG. 2 is a view in which the embodiment of the invention is seen from the backside.
Figure 3:
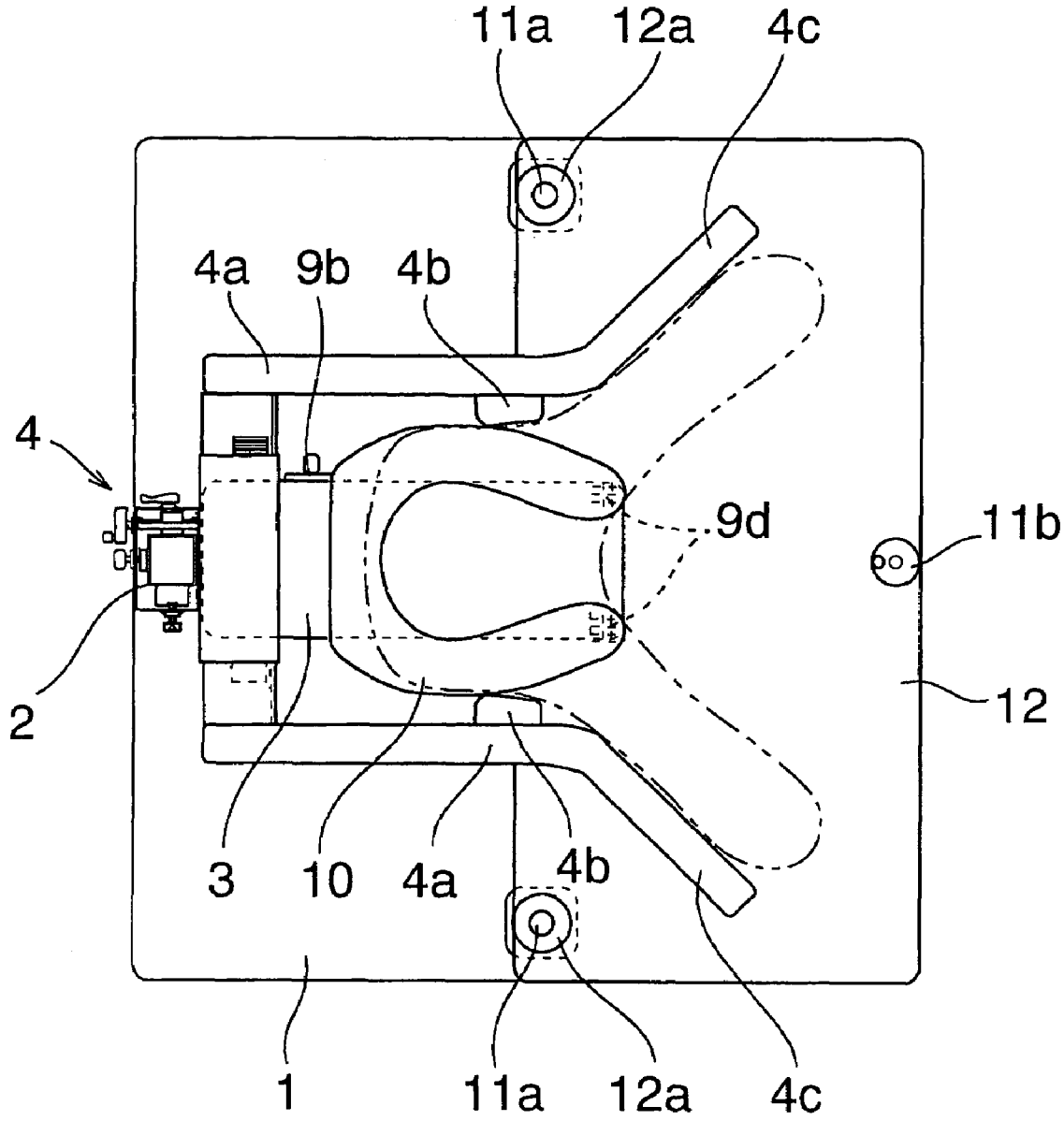
FIG. 3 is a section view taken along the line A-A in FIG. 1.
Figure 4:
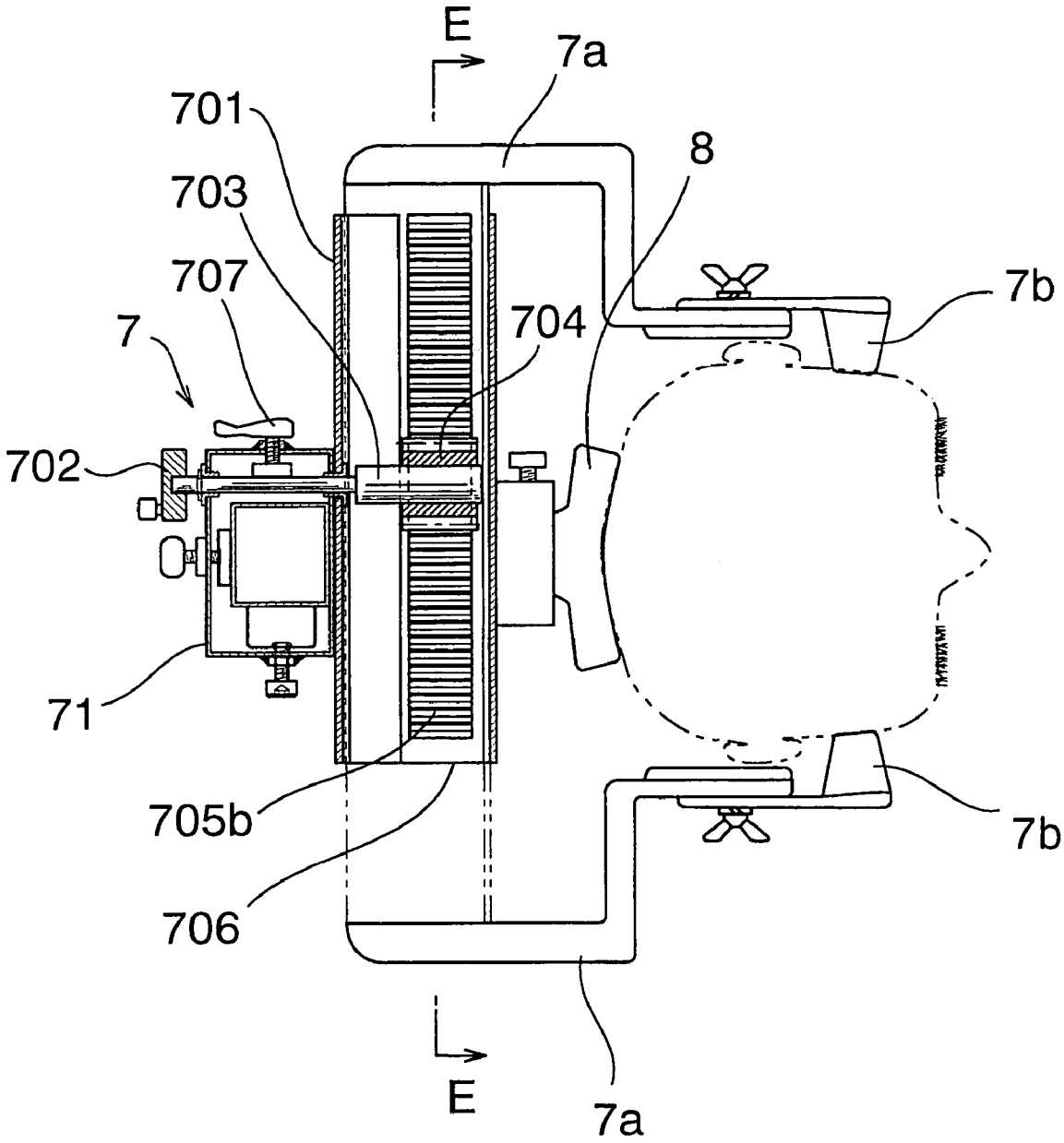
FIG. 4 is a section view taken along the line B-B in FIG. 1.
Figure 5:
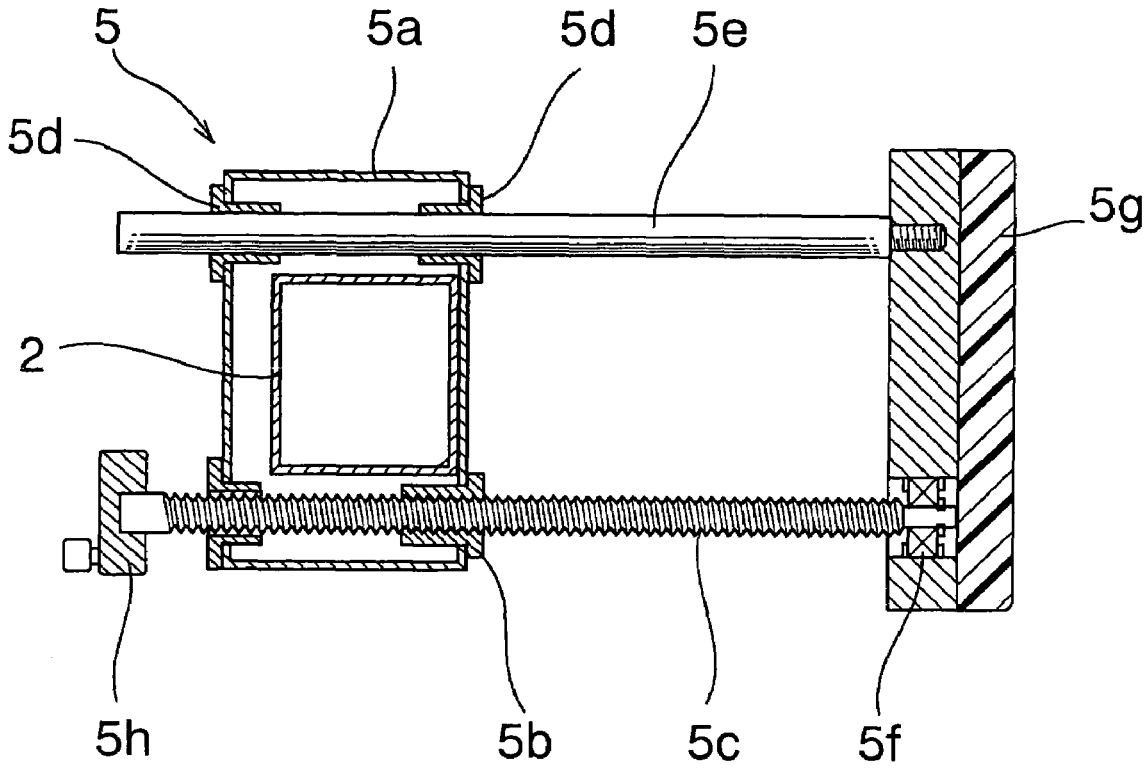
FIG. 5 is a section view taken along the line C-C in FIG. 1.

FIG. 1 is a view in which an embodiment of the invention is seen from one side, and FIG. 2 is a view in which the embodiment is seen from the backside. FIG. 3 is a section view taken along the line A-A in FIG. 1, FIG. 4 is a section view taken along the line B-B in FIG. 1, and FIG. 5 is a section view taken along the line C-C in FIG. 1.

A vertical column 2 is fixed to a base plate 1 set on a floor F. A base end of a seat supporting member 3 is fixed to the column 2. Also a pelvis-and-knee position regulating mechanism 4, a lumbar vertebra pressing mechanism 5, an armpit position regulating mechanism 6, and a cranium position regulating mechanism 7 are mounted on the column 2 in this sequence as advancing from the lower side. In addition, a cranium fore-and-aft position regulating member 8 is mounted on the column.

A pinion 9*a* is rotatably supported on the seat supporting member 3 by a pillow block, etc. The pinion 9*a* is rotated by operating a handle 9*b*. A rack 9*c* extending in a vertical direction is engaged with the pinion 9*a*. A rear end portion of a seat 10 is pin-coupled to an upper end portion of the rack 9*c*. As shown in FIG. 3, the seat 10 has a substantially U-like shape in which end portions are branched. The end portions are supported by the seat supporting member 3 via two hinges 9*d*. When the pinion 9*a* is rotated by operating the handle 9*b*, therefore, the rack 9*c* is vertically moved, thereby changing the angle formed by the surface (the seat face) of the seat 10 and the horizontal plane. The pinion 9*a*, the rack 9*c*, the hinges 9*d*, and the like constitute a seat face angle adjusting mechanism 9.

Two vertical guides 11*a* are fixed to the base plate 1, and a vertical screw 11*c* having a handle 11*b* is rotatably supported on the base plate. A foot sole placing plate 12 is supported at three points by these members. Specifically, nuts (not shown) are slidably screwed to the respective vertical guides 11*a* via bushes 12*a*, and a nut (not shown) which is fixed to the foot sole placing plate 12 is screwed to the screw 11*c*. When the screw 11*c* is rotated by operating the handle 11*b*, therefore, the foot sole placing plate 12 is vertically moved while maintaining the horizontal condition. As a result of this operation, the distance in the vertical direction between the seat face of the seat 10 and the surface of the foot sole placing plate 12 can be changed. The height of the foot sole butting plate 12 is adjusted so that the soles of the both feet are closely in contact with the foot sole butting plate 12 respectively in a condition where a subject sits on the seat 10.

The pelvis-and-knee position regulating mechanism 4, the lumbar vertebra pressing mechanism 5, the armpit position regulating mechanism 6, and the cranium position regulating mechanism 7 include vertical movement mechanisms, respectively, for vertically moving them along the column 2. The vertical movement mechanisms will be described later in detail. Each of the pelvis-and-knee position regulating mechanism 4, the armpit position regulating mechanism 6, and the cranium position regulating mechanism 7 includes: a pair of butting members which butt against the corresponding region of the subject from the right and left sides, thereby positioning the region; and a mechanism which moves the pair of butting members so that they mutually approach/separate on both sides of the center line in the right-and-left direction of the chair (hereinafter, simply referred to as the center line of the chair) by equal distances. The approaching/separating mechanism will be described later in detail.

As shown in FIG. 3, the pelvis-and-knee position regulating mechanism 4 includes: a pair of arms 4*a* which are caused to mutually approach/separate by equal distances on both sides of the center line of the chair by means of the approaching/separating mechanism that will be described later; and a pair of pelvis butting members 4*b* which are fixed on the inner sides of the respective arms 4*a* to butt against the pelvis of the subject from the right and left sides. A curvature portion 4*c* which is bent so as to open at 45 degrees with respect to the center line of the chair is disposed on the tip end of each of the arms 4*a*. In the knee position regulating mechanism 4, the pair of arms 4*a* are approached/separated from the pelvis of the subject who sits on the seat 10 from the right and left sides, and the pelvis butting members 4*b* are caused to butt against the pelvis from the right and left sides. In this condition, the subject opens the legs, so that the outsides of the legs butt against the curvature portions 4*c* of the arms 4*a*, respectively. As a result, the subject is in a condition where the both legs are opened by 45 degrees toward right and left sides in a condition where the pelvis is restricted from the right and left sides.

The armpit position regulating mechanism 6 has: a pair of arms 6*a* which are to be held by the respective armpits of the subject who sits on the seat 10; and an approaching/separating mechanism which approaches/separates the pair of arms 6*a* by equal distances on both sides of the center line of the chair. When the arms 6*a* are adjusted so as to butt against the trunk from the right and left sides in portions directly below the armpits of the subject, the positions in the right-and-left direction of the trunk in the armpit regions are regulated.

As shown in FIG. 4, the cranium position regulating mechanism 7 includes: a pair of arms 7*a* which are caused to approach/separate from one another by equal distances on both sides of the center line of the chair by an approaching/separating mechanism that will be described later; and a pair of cranium butting members 7*b* which are fixed on the inner sides of the respective arms 7*a* so as to extend around the ears of the subject who sits on the seat 10 and also to butt against the vicinities of zygomatic arches from the right and left sides. The fore-and-aft positions of the cranium butting members 7*b* with respect to the respective arms 7*a* can be adjusted. The cranium position regulating mechanism 7 regulates the position in the right-and-left direction of the cranium of the subject who sits on the seat. The cranium fore-and-aft position regulating member 8 is attached to the vertical movement mechanism which is shared also by the cranium position regulating mechanism 7. The cranium fore-and-aft position regulating member butts against the back of the head of the subject, and regulates the position of the cranium so that the line of vision of the subject is substantially horizontal. The position of the cranium fore-and-aft position regulating member 8 can be adjusted in the fore-and-aft direction.

As shown in FIG. 5, the lumbar vertebra pressing mechanism 5 is mainly constituted by: a case 5*a* which is vertically moved with respect to the column 2; nuts 5*b* fixed to the case 5*a*; a screw rod 5*c* screwed into the nuts 5*b*, a guide bar 5*e* which is supported by the case 5*a* via bushes 5*d* so as to be slidable in the axial direction; and a pressing member 5*g* which is screwed and fixed to the guide bar 5*e*, and which rotatably supports the screw rod 5*c* via a bearing 5*f*. The screw rod 5*c* can be rotated by a handle 5*h*. According to the configuration, when the handle 5*h* is rotated, the pressing member 5*g* is moved in the fore-and-aft direction, so as to press appropriate portions of the lumbar vertebra of the subject who sits on the seat 10, thereby regulating the position of the lumbar vertebra in the fore-and-aft direction.

Figure 6:
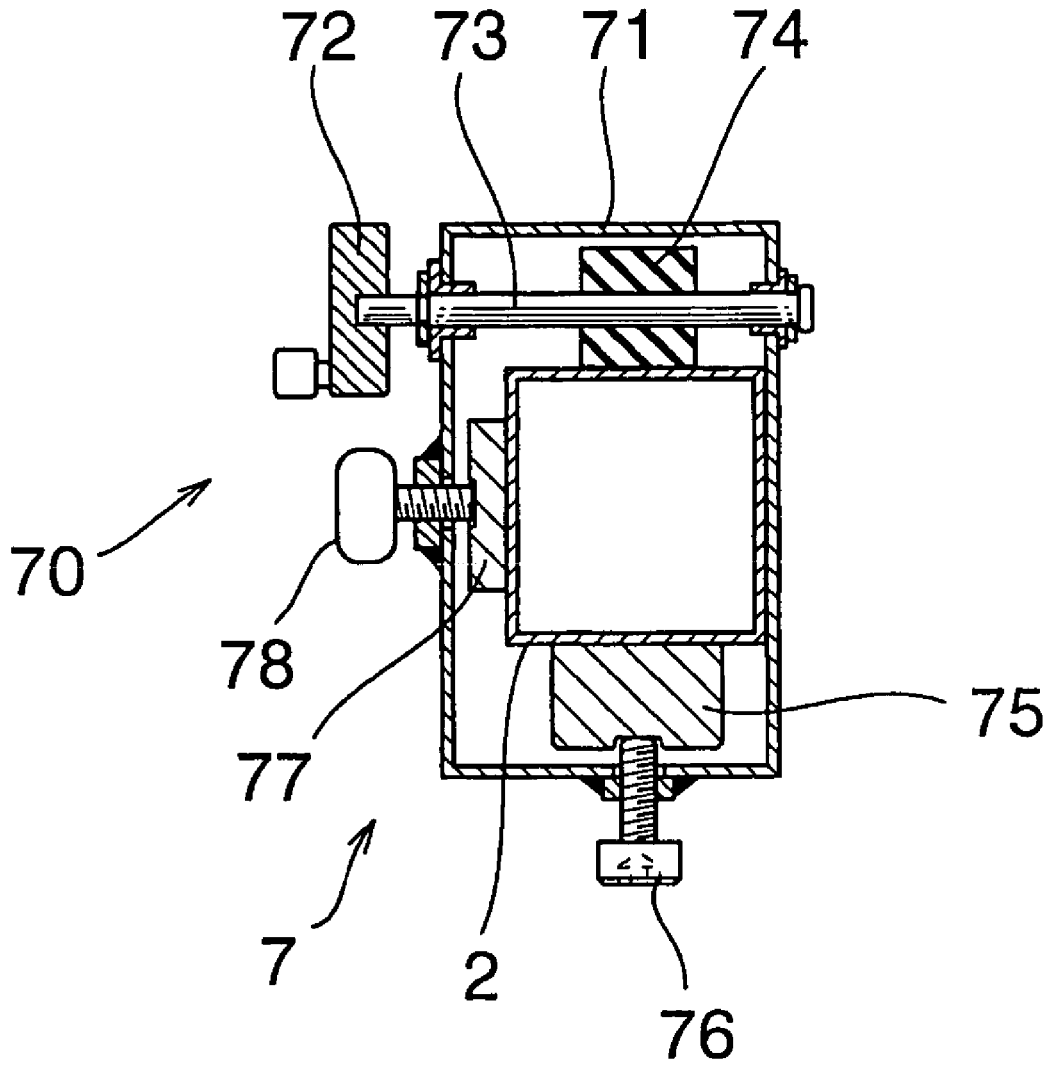
FIG. 6 is a section view taken along the line D-D in FIG. 1.

As for the vertical movement mechanisms included in the above-mentioned respective mechanisms, the mechanism of the cranium position regulating mechanism 7 will be described below as the representative. As shown in FIG. 6 which is a section view taken along the line D-D in FIG. 1, the vertical movement mechanism 70 comprises: a case 71 which is vertically moved with respect to the column 2; a rotating shaft 73 in which both end portions are supported by the case 71, and which is integrated with a handle 72; and a rubber ring 74 which is fixed to the rotating shaft 73 inside the case 71 so as to butt against one side face of the column 2. The vertical movement mechanism further comprises: a pressurization applying member 75 which butts against the other side face of the column 2 opposite to the rubber ring 74; an adjusting screw 76 which adjusts a pressing force of the pressurization applying member 75 against the column 2; and a fixing screw 78 which presses a pressing member 77 against the back face of the column 2, thereby preventing the case 71 from being moved with respect to the column 2. According to the configuration, when the handle 72 is rotated in a condition where the fixing screw 78 is loosed, the rubber ring 74 to which appropriate pressurization against the column 2 is applied by the pressurization applying member 75 is rotated, so that the case 71 is moved vertically with respect to the column 2. After the position in the vertical direction of the case 71 is determined, the fixing screw 78 is fastened. Thus, the case 71 is fixed to the column 2 in the position, and the adjustment of the position in the vertical direction is completed.

Figure 7A:
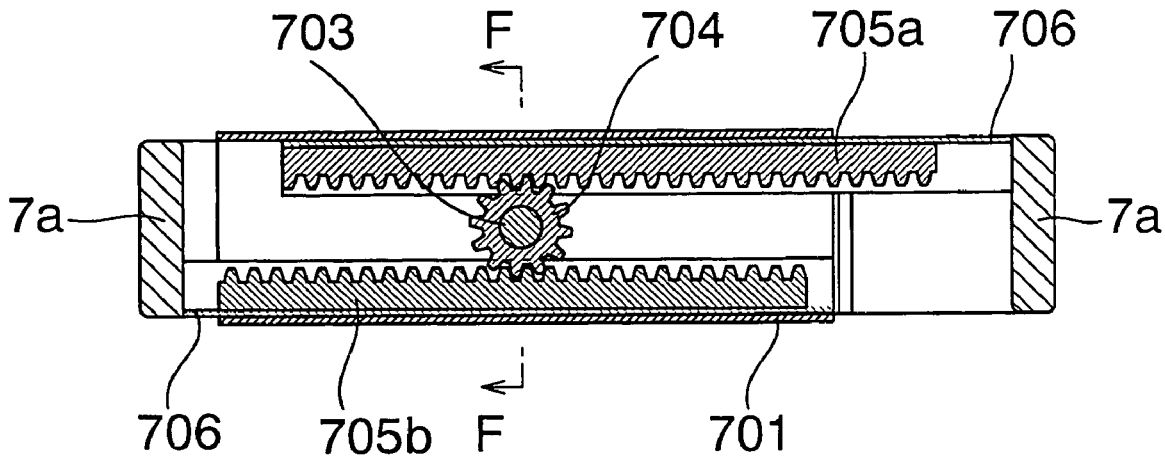
FIG. 7A is a section view taken along the line E-E in FIG. 4.
Figure 7B:
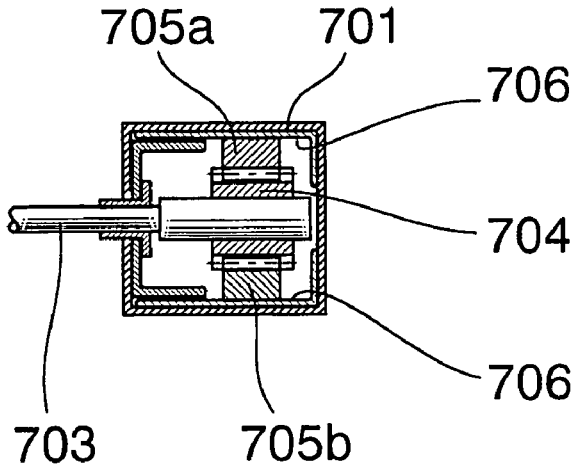
FIG. 7B is a section view taken along the line F-F in FIG. 7A.

Next, as for the approaching/separating mechanisms included in the pelvis-and-knee position regulating mechanism 4, the armpit position regulating mechanism 6, and the cranium position regulating mechanism 7, the approaching/separating mechanism of the cranium position regulating mechanism 7 will be described as the representative. In the following, description will be made with reference to FIG. 4, FIG. 7A which is a section view taken along the line E-E in FIG. 4, and FIG. 7B which is a section view taken along the line F-F in FIG. 7A.

The approaching/separating mechanism 700 is mounted on the case 71 of the above-mentioned vertical movement mechanism 70 which is attached to the column 2. The approaching/separating mechanism is mainly constituted by: a supporting member 701 which is fixed to the case 71; a rotating shaft 703 which is rotatably supported by the case 71, and which is rotated by the rotation of a handle 702; a pinion 704 which is fixedly attached to the rotating shaft 703; two racks 705*a* and 705*b* which are engaged with upper and lower portions of the pinion 704, respectively; upper and lower guides 706 which are fixed to the supporting member 701 to support the racks 705*a* and 705*b* so as to be movable in the right-and-left direction; and a fixing screw 707 which prevents the rotating shaft 703 from being rotated. The right and left arms 4*a* of the cranium position regulating mechanism 7 are fixed to the racks 705*a* and 705*b*, respectively.

In this configuration, when the handle 702 is operated so as to rotate the pinion 704 via the rotating shaft 703 in a condition where the fixing screw 707 is loosed, the upper and lower racks 705*a* and 705*b* are moved in opposite directions, that is, moved by equal distances in right-and-left directions so as to mutually approach/separate. As a result, the pair of right and left arms 4*a* are moved by equal distances so as to mutually approach/separate on both sides of the center line of the chair.

An example of the method of using the above-described embodiment of the invention will be described. After a subject sits on the seat 10, first, the foot sole placing plate 12 is vertically moved to be adjusted so that the soles of the feet of the subject who sits on the seat 10 is closely in contact with the surface of the foot sole placing plate 12. The angle of the seat face is adjusted as needed.

Next, the pelvis-and-knee position regulating mechanism 4 is adjusted, so as to regulate the position in the right-and-left direction of the pelvis of the subject, and the knees are opened by 45 degrees with respect to the center of the chair. Thereafter, the height of the pressing member 5*g* of the lumbar vertebra pressing member 5 is adjusted so as to coincide with that of the lumbar vertebra, thereby causing the subject to take a posture in which the lumbar region (the vicinity of the navel) is put forward. In order not to loose the posture (in order not to return to the original position), the position of the pressing member 5*g* is adjusted so as to butt against the lumbar vertebra in this condition.

Next, the arms 6*b* of the armpit position regulating mechanism 6 are adjusted so as to have a width suitable for the body of the subject, and then the armpit position regulating mechanism 6 is moved upwardly, and stopped at the armpit position. Thus, the subject cannot move in the right-and-left direction. Thereafter, the positions of the cranium pressing members 7*b* of the cranium position regulating mechanism 7 are adjusted so as to coincide with the height of the right and left zygomatic arches of the subject. In addition, the fore-and-aft positions of the cranium pressing members 7*b* are adjusted, so that the tip ends of the cranium pressing members 7*b* butt against the zygomatic arches. At this time, the cranium fore-and-aft position regulating member 8 is adjusted, so that the line of vision of the subject is substantially horizontal.

At the timing when the adjustments of these portions are completed, the subject is set in a condition where planes centered in the right-and-left direction of the cranium and the pelvis are positioned on a common vertical plane (a plane along the direction of gravity) along the center of the chair, i.e., along the vertical column 2. In addition, the soles of the feet are closely in contact with the foot sole placing plate 12, in a condition where the knees are opened by 45 degrees, respectively, while setting the common vertical plane as the center. Because of the regulations of the cranium fore-and-aft position regulating mechanism 5 and the cranium fore-and-aft position regulating member 8 in this condition, moreover, the S-shaped physiological curvature of the subject from the lower part of the body of the subject, to the pelvis, the lumbar vertebra, the dorsal vertebra, and the cervical vertebra is restored.

When this condition is maintained, deviations of the physiological curvature existing in the subject, and those of the head in the fore-and-aft direction and the right and left direction can be easily known. Therefore, a treatment policy for synthetically pursuing the balance can be found out. When the dental occlusion in this condition is measured, moreover, a treatment policy relating to the dental occlusion can be correctly found out.

In the above-described embodiment, the vertical movement, the right-and-left movement, and the fore-and-aft movement of the respective regulating mechanisms are performed by operating the respective handles. Alternatively, an actuator such as a pulse motor may be driven so as to perform the movement in each direction of the respective mechanisms. In the alternative, the chair may be configured in the following manner. The pulse motors and the like are controlled by a personal computer, and the positions of the respective mechanisms and pressing members as a result of driving of the pulse motors are stored in a memory for each subject. When an instruction is given with using the stored contents, the mechanisms and the members are automatically moved to positions corresponding to the subject. According to the configuration, when the adjustment for a subject is once performed, it is substantially unnecessary to perform the second and subsequent adjustments.

The column 2 is required to be vertically disposed in a substantially correct manner. The following configuration may be employed. A leg for horizontal adjustment is disposed below the base plate 1, and a plumb bob is suspended in the interior of the column 2. A ring is disposed around the plumb bob, and the leg for horizontal adjustment is adjusted so that the plumb bob is positioned at the center of the ring. According to the configuration, the column can be easily disposed.

What is claimed is:

1. A medical chair which is mainly useful for maintaining a relaxed condition of muscular tension of a human body in a condition where physiological curvature of individual vertebrae is realized and human body extends along a direction of gravity, and characterized in that said chair comprises cranium position regulating means and pelvis-and-knee position regulating means for respectively regulating a position of a cranium and a position of a pelvis of a subject who sits on a seat, and said cranium position regulating means and said pelvis-and-knee position regulating means butt against both right and left sides of the cranium and the pelvis, respectively to cause both planes centered in a right-and-left direction of the cranium and the pelvis to be in a same central plane which extends in the direction of gravity, said pelvis-and-knee position regulating means further including knee butting means for butting against the outside of the knees of the subject in a seated condition to cause an angle formed by the knees to be bilaterally symmetrical about the central plane, thereby fixing positions of the knees.

2. A medical chair according to claim 1, wherein said chair further comprises height adjusting means for adjusting a vertical distance between a foot sole placing plate and a seat face, to cause soles of feet of the subject in a seated condition to be closely in contact with a horizontal plane.

3. A medical chair according to claim 1 or 2, wherein said chair further comprises lumbar vertebra pressing means for, from a rear side, pressing lumbar vertebra of the subject in a seated condition at a predetermined height from said seat.

4. A medical chair according to claim 1 or 2, wherein said chair further comprises armpit position regulating means for butting against both armpits of the subject in a seated condition to cause a plane centered in the right-and-left direction of the armpits to be in the central plane thereby fixing positions of the armpits.

5. A medical chair according to claim 1 or 2, wherein said chair further comprises cranium fore-and-aft position regulating means for butting against a back of a head of the subject in a seated condition, thereby regulating a position of the cranium in a fore-and aft direction.

6. A medical chair according to claim 1 or 2, wherein said chair further comprises seat face angle adjusting means for changing an angle of a seat face of said seat with respect to a horizontal plane.

7. A medical chair according to claim 1 or 2, wherein a hole or a recessed portion is formed in a substantially central portion of a seat face of said seat.

8. A medical chair according to claim 1 or 2, further comprising armpit position regulating means and wherein each of said cranium position regulating means, said pelvis-and-knee position regulating means, and said armpit position regulating means includes: a pair of regulating members which are respectively positioned on right or left sides of the subject in a seated condition, and which butt against a corresponding region; and an adjusting mechanism which moves said pair of regulating members in a horizontal direction, and each of said adjusting mechanisms moves said pair of regulating members by equal distances in a bilaterally symmetric manner about a center line of said chair.

9. A medical chair according to claim 1 or 2, further comprising armpit position regulating means having armpit position regulating members and lumbar vertebra pressing means having lumbar vertebra pressing members and wherein, in said cranium position regulating means, said armpit position regulating means, and said lumbar vertebra pressing means, said armpit position regulating members and said lumbar vertebra pressing members butting against the subject are disposed in a vertically movable manner by means of respective vertical movement mechanisms in accordance with a body shape of the subject.

10. A medical chair according to claim 1 or 2, further comprising armpit position regulating means, lumbar vertebra pressing means, and seat face angle adjusting means and wherein said chair further comprises storing means for storing positions of pairs of regulating members in said cranium position regulating means, said pelvis-and-knee position regulating means, and said armpit position regulating means, a position of a pressing member in said lumbar vertebra pressing means, or an angle of a seat face in said seat face angle adjusting means for each subject, and, when energized, and the positions of said pairs of regulating members and said pressing member, or the angle of said seat face are moved to positions or an angle corresponding to the subject, by means of actuators, based on the stored positions in said storing means.

* * * * *